United States Patent [19]

Rohde

[11] Patent Number: 4,829,656

[45] Date of Patent: May 16, 1989

[54] PROCESS FOR MAKING HOT-ROLLED STEEL STRIP

[75] Inventor: Wolfgang Rohde, Dormagen, Fed. Rep. of Germany

[73] Assignee: SMS Schloemann-Siemag Aktiengesellschaft, Dusseldorf, Fed. Rep. of Germany

[21] Appl. No.: 103,529

[22] Filed: Sep. 30, 1987

[30] Foreign Application Priority Data

Oct. 13, 1986 [EP] European Pat. Off. ..... 86114160.4

[51] Int. Cl.[4] ..... B21B 1/46

[52] U.S. Cl. ..... 29/527.7; 72/200; 432/120; 432/121

[58] Field of Search ..... 29/527.7; 72/200; 432/120, 121, 122, 128

[56] References Cited

U.S. PATENT DOCUMENTS

| | | | |
|---|---|---|---|
| 4,217,095 | 8/1980 | Takitsu | 29/527.7 |
| 4,229,878 | 10/1980 | Ushijima | 29/527.7 |
| 4,586,897 | 5/1986 | Weber et al. | 72/200 X |

FOREIGN PATENT DOCUMENTS

| | | | |
|---|---|---|---|
| 3310867 | 10/1984 | Fed. Rep. of Germany . | |
| 3422922 | 6/1985 | Fed. Rep. of Germany . | |
| 57-146402 | 9/1982 | Japan . | |
| 57-202907 | 9/1982 | Japan . | |
| 61481 | 12/1982 | Japan | 72/200 |
| 58-20301 | 2/1983 | Japan . | |
| 58-221602 | 12/1983 | Japan | 72/200 |
| 59-30401 | 2/1984 | Japan | 29/527.7 |
| 60-96302 | 5/1985 | Japan | 29/527.7 |
| 06255201 | 12/1985 | Japan | 29/527.7 |
| 417505 | 11/1974 | U.S.S.R. . | |
| 2129723 | 5/1984 | United Kingdom . | |

*Primary Examiner*—Carl J. Arbes

*Attorney, Agent, or Firm*—Herbert Dubno

[57] ABSTRACT

To make hot rolled steel strap from strap like cast starting material cast pieces can be first cut from the solidfying casting after the casting process is completed. Then these cast pieces are guided to and stored in an oven where they are brought to and maintained at the rolling temperature. The cast pieces are fed in succession into the rolling mill. Then the cast pieces are stored there at the rolling temperature until the rolling process begins. A number of cast pieces are produced as raw products in our invention and stored until the rolling of these individual cast pieces starts. the casting is continuous and occurs also during the rolling operation. Because of the intermediate storage provided by the oven significant differences can exist between the casting time and the rolling time. Assembly and maintenance of the rolling mill, e.g. roll changing, can be performed in a pause of the roll cycle which includes the rolling time. If necessary the two pauses of two roll cycles are placed immediately in succession. The cast pieces formed during this time are fed to the oven and stored there. An apparatus for performing this process is also described.

4 Claims, 2 Drawing Sheets

PROCESS FOR MAKING HOT-ROLLED STEEL STRIP

FIELD OF THE INVENTION

My present invention relates to a process and apparatus for making hot-rolled steel strip and, more particularly, to a process and apparatus for making a hot-rolled steel strip from striplike continuously cast billets.

Specifically, the invention relates to a process for making a hot-rolled steel strip from continuously cast billets in which a plurality of continuously cast long billets of equal length are cut away from a solidifying continuous casting and the continuously cast long billets are guided in succession to a furnace, fed into the furnace and brought to and maintained at the rolling temperature and finally the continuously cast long billets are fed in succession at the rolling temperature into a rolling mill to perform the rolling process.

The invention also relates to an apparatus for performing this process comprising a casting machine for the continuous casting of a striplike casting, a transverse dividing device for dividing the solidifying casting into a plurality of continuously cast long billets and a furnace for the continuously cast long billets, as well as a rolling mill following it.

BACKGROUND OF THE INVENTION

Steel strip hot-rolled from the cast raw material or billets directly in successive process steps has been described in German Patent No. 32 41 745. After the striplike continuous casting is formed and after its complete solidification it is rolled up into a coil at the casting speed and then the castings are separated and removed after reaching the permitted or desired coil weight. Then after an intervening storage in the furnace, the coil is transferred to an unwinding device. There the unwinding of the casting from the coil occurs. Then the unwound casting is fed into the rolling mill for rolling to make the steel strip.

The plant for performing the process includes a continuous casting plant for casting a striplike continuous casting, a winding device forming a coil from the billet following the casting machine, a transverse dividing device provided between the casting machine and the winding device, a storage furnace for the coils, an unwinding device for unwinding the casting to a flat strand and a rolling mill for rolling the unwound casting to a linear hot-rolled strip with this unwinding device.

According to German Patent No. 32 41 745 beneficial prerequisites for economical manufacture of steel strip from cast raw material are provided since the device required in the usual hot rolling of steel strip for reheating the cast slabs is not required and also expensive intermediate conveyor devices and intermediate storage locations are avoided. Also the expensive deformation required for the rolling of conventional cast slabs and the high energy consumption required for that deformation are avoided.

According to German Patent No. 32 41 745 also the problems resulting from the different speeds in casting of the starting or raw materials and in the subsequent rolling are eliminated because rolling the long cast billet in a coil after the casting provides a buffer between the casting unit and the rolling mill. Thus there is no direct dependence of the casting speed and the rolling speed.

Noticeable drawbacks in this process and in the plant have arisen in practice. Not every striplike cast raw material can be wound to a coil directly after its solidification. Therefore a reducing rolling mill must be provided between the casting machine or unit and the winding device with which the casting, at a temperature between the solidification temperature and the usual rolling temperature, is reduced to a cross section suitable for winding and for subsequent unwinding at the rolling temperature.

It is disadvantageous in practice that the cooling of the long cast billet wound to a coil from the solidifying temperature to the rolling temperature does not occur uniformly in a furnace but is more rapid in the outer coil layers of the coiled strip than in the interior layers of the coil.

In the rolling process connected with the unwinding of the long cast billet from the coil the long cast billet has a necessarily variable temperature profile in its longitudinal direction by which the quality of the steel strip made by the subsequent rolling process can be permanently damaged. Since the rolling cycle is comparatively short compared to the unrolling of the casting from the coil, a temperature compensation or balancing in the longitudinal direction of the unwound long cast billet can no longer take place a practical manner.

OBJECTS OF THE INVENTION

It is an object of my invention to provide an improved process and apparatus for making a hot-rolled steel strip which obviates drawbacks of earlier techniques.

It is also an object of my invention to provide an improved process and apparatus for making a hot-rolled steel strip with which or by which the steel strip can be rolled from continuously cast long billets which have a constant temperature profile over their entire length so that a high quality end product is obtained.

SUMMARY OF THE INVENTION

These objects and others which will become more readily apparent hereinafter are attained in accordance with my invention in a process for making a hot-rolled steel strip from a striplike continuously cast billet comprising cutting away a succession of continuously cast long billets from a continuous casting solidifying after having been produced in a continuous casting process, then feeding the continuously cast long billets in succession to a furnace, bringing them to and maintaining them at the rolling temperature and finally feeding the continuously cast long billets in succession at the rolling temperature into a rolling mill which performs the rolling process.

The objects are also attained in an apparatus for performing this process comprising a continuous casting machine for the continuous casting of a striplike casting, a transverse dividing device for dividing the solidifying continuous casting into a plurality of continuously cast long billets and a furnace for the continuously cast long billets as well as a rolling mill following it.

According to my invention the process for making hot-rolled steel strip comprises feeding the continuously cast long billets into the furnace and storing them in the furnace in an extended stretched out or nonrolled form until the rolling process begins so that a number of the continuously cast long billets are stored before the beginning of their rolling, continuously running the continuous casting process during the rolling and feeding of the oncoming long billet thereby into the furnace and storing the billet there until its turn to be rolled is reached.

According to my invention in the apparatus for performing my process the furnace used is a storing furnace having a plurality of main storage locations for receiving the continuously cast long billets in a stretched-out form and between which the billets are shifted by a transverse conveyor. The storing furnace with its transverse conveyor is equipped for receiving a number of long cast billets.

By the given process steps according to my invention each cast piece remains in the storing furnace between the ending of its continuous casting process and the beginning of the rolling cycle for that billet for a comparatively long time and during this time interval essentially and practically with no additional energy input the continuously cast long billets are brought from their casting temperature to the required rolling temperature and are maintained at that temperature.

Since a number of continuously cast long billets in outstretched form always remain in the furnace between the time of their storage in the furnace and the beginning of the rolling process a uniform temperature profile is developed over their entire length.

According to an embodiment of my invention each cast piece is brought in the storing furnace from its casting temperature, advantageously about 1150° C., to its rolling temperature, advantageously about 1050° C., and also its dwell time in the furnace is adjusted to an integral number times the casting time for a cast billet.

For example if the casting time for a cast piece with a cross section having dimensions 50×1600 mm with a 50 meter length is about 12.5 minutes, then the residence time for the individual cast piece in the furnace should be about 4×12.5 or 50 minutes, within which the rolling temperature is adjusted over the entire length of the cast piece to be as uniform as possible.

An optimum operation according to my invention is attained when the rolling cycle for an individual one of the continuously cast long billets agrees substantially with the casting time for the cast piece and thus each of the roll cycles comprises a comparatively short rolling time and a comparatively long pause.

When for example the casting time for an individual long cast billet of 50 meter length amounts to about 12.5 minutes the rolling cycle for one such long cast billet should comprise a time interval of 12.5 minutes. If the actual rolling time is about 2.5 minutes, a subsequent pause forms part of the rolling cycle can, comprise about 10 minutes.

It is particularly advantageous when the assembly operations in the rolling mill in which roll changing occurs are provided in the pause of a roll cycle and if necessary two pauses of two of the roll cycles are placed in succession and the continuously cast long billets are also fed into the furnace during the pauses and stored there.

Ordinarily pauses of about 10 minutes suffice between successive rolling processes to perform the assembly work required at the rolling mill. This includes roll changing. If it happens that an available pause is not long enough to complete the assembly work then, advantageously according to my invention, two pauses can be arranged immediately in succession. Then for subsequent normal running of additional rolling cycles two rolling times can be arranged immediately in succession.

The storing furnace can contain a large number of main storage locations loadable successively with the continuously cast long billets. The number of these locations depends on the difference between a dwell time required for the continuously cast long billets in the storing furnace and a casting time for an individual cast piece.

If the casting time is about 12.5 minutes and the dwell time is about 50 minutes, then the storing furnace according to the ratio 4:1 (ratio of stored billets to billet operated upon) has four main storage location for the continuously cast long billets.

In a particularly important embodiment of the apparatus according to my invention for making hot-rolled steel strip the storing furnace contains buffer storage locations for the continuously cast long billets as well as main storage locations which are additionally loadable with continuously cast long billets in continuous operation of the cast apparatus during extended idle times of the rolling mill between the rolling times of two successive rolling cycles.

According to my invention it is particularly advantageous when the main storage locations in the storing furnace are substantially horizontally adjacent each other while the buffer storage locations are positioned one above another vertically and are laterally positioned relative to the main storage locations.

While usually the main storage locations are located approximately at equal height in the apparatus according to my invention the buffer storage locations inside the storing furnace can be positioned individually in succession on the transport plane of the continuously cast long billets and the main storage locations.

The finished continuously cast long billets in continuous operation of the casting machine during a required extended stop time of the rolling mill can be received in the main storage locations in the storing furnace with comparatively little additional expense and small spatial requirements without damage and may be rolled to a steel strip completely without problems by corresponding enlargement of the successive rolling cycles after finishing the idle times of the rolling mill, since then—with constant rolling time the successive rolling cycles are shortened by a corresponding reduction of the pause time.

If the effective rolling time for an individual cast piece amounts to about 2.5 minutes and if the pause time amounts to about 10 minutes in a standard rolling cycle, then during this standard pause time two continuously cast long billets from the buffer storage locations can be rolled without problem when the effective pause time between two rolling times is reduced to about 1.7 minutes. During two standard rolling cycles up to four additional long cast billets received in the buffer storage locations can be rolled while allowing the normal subsequent operation of the apparatus.

According to a particularly advantageous embodiment of the apparatus according to my invention the number of the buffer storage locations in the storing furnace is at least equal to the number of the main storage locations.

For normal operation of the apparatus it can be important that a delivery device for the continuously cast long billets is provided between the longitudinal conveyor for the individual continuously cast long billets and the transverse conveyor of the main storage locations and the buffer storage locations, which can be put into operation when the continuously cast long billets must be received from the longitudinal conveyor or should be delivered from them to the transverse conveyor for the main storage locations.

Also advantageously the rolling mill following the storing furnace can be a continuous finishing line. This continuous finishing line can be equipped both with a standard finishing rolling mill and also with a compact finishing rolling mill.

It is also possible that the rolling mill following the storing furnace is designed as a reversing rolling mill, especially a pin rolling mill with a outlet side and an inlet side coiler and/or a coil furnace.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
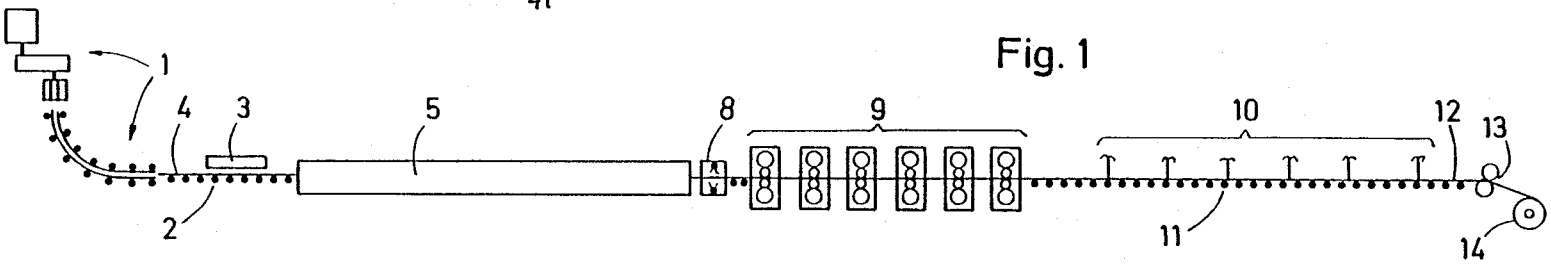
FIG. 1 is a principal side elevational schematic view of one embodiment of a plant for making hot-rolled steel strip from continuously cast billets according to my invention.

According to FIGS. 1, 2, 4 and 5 of the drawing the plant for making hot-rolled steel strip has a continuous casting machine 1 at whose outlet a roller bed 2 is connected. A torch cutter 3 acting as a transverse dividing device for dividing the casting 4 from the casting machine 1 displaced across the roller bed 2.

The molten material forming the casting 4 is cooled on the curved guide of the continuous casting machine 1. The outlet temperature of the casting 4 at the end of the curved guide is above 1150° C.

The solidifying casting 4 is guided into a storing furnace 5 at a temperature of about 1150° C. and is received by it on a conveyor connected to the roller bed 2. The casting 4 is divided by the torch cutter 3 functioning as a transverse dividing device into continuously cast long billets 4*a* of a predetermined length, e.g. of 50 meters.

The continuously cast long billets 4*a* fed into the storing furnace 5 are moved then by a transverse conveyor device 6 inside the storing furnace 5 transversely to their longitudinal direction in a stepwise manner. The transverse conveyor device 6 has several, e.g. four, main storage locations 41 positioned side by side. The first of these main storage locations 41 is located in the storing furnace 5 in axial alignment with the roller bed 2, while the last storage location 41 is provided in axial alignment with a delivery roller bed 7 following the storing furnace 5.

Inside of the storing furnace 5 a conveyor is associated with the delivery roller bed 7 with whose help continuously cast long billets 4*a* brought to the last storage location 41 by the transverse conveyor 6 from the storing furnace 5 can be fed to the delivery roller bed 7.

If it is assumed that the casting machine 1 for the casting 4 with a longitudinal dimension suitable for a cast piece 4*a* of 50 meters requires a casting time of 12.5 minutes then the transverse conveyor 6 must perform a transport step in an operating time of 12.5 minutes inside the storing furnace 5 and because of that the dwell or residence time of the cast piece 4*a* in the storing furnace 5 amounts to about 50 minutes before it is delivered to a delivery roller bed 7. The emptying cycle can be adjusted to a shorter residence time. The individual continuously cast long billets 4*a* inside the storing furnace 5 while retaining their stretched-out form are brought from the entrance temperature of 1150° C. to an outlet temperature of about 1050° C. corresponding to the rolling temperature. The temperature reduction of about 100° C. inside the storing furnace 5 can occur practically without outside energy input. Thus the temperature profile in the longitudinal direction of the individual continuously cast long billets drops very uniformly.

The individual continuously cast long billets 4*a* are guided from the delivery roller bed 7 through a descaling station 8 and reach a continuous finishing line 9 which includes four-high rolling mills. A cooling stage 10 which is effective adjacent a transport roller bed 11 follows the continuous finishing line 9. The finished steel strip 12 is fed from the transport roller bed 11 to a coiler 14 and is wound to a strip coil on it.

The conveyor associated with the last storage location 41 of the transverse conveyor 6 in the supply over 5 can be designed as a oscillating conveyor with whose help the cast piece 4*a* located thereon may be moved to and fro in the longitudinal direction to a limited extent inside the storing furnace 5 as required.

Figure 2:
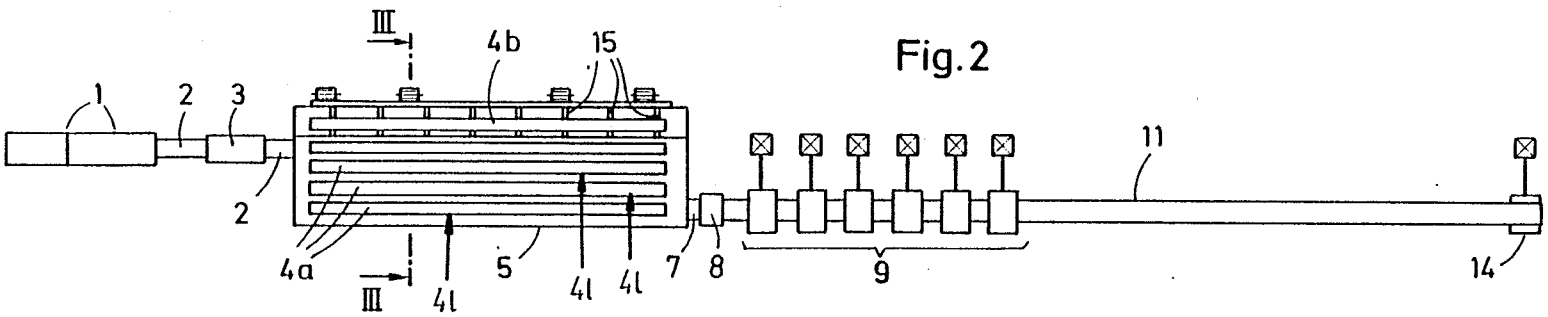
FIG. 2 is a top plan view of the plant according to FIG. 1.

It is apparent in the plant shown in FIGS. 1 and 2 that from the beginning of the continuous casting process to the beginning of the rolling process a number, namely four, continuously cast long billets 4*a* are stored as raw products in the furnace in stretched-out form. By that it is intended that the individual continuously cast long billets inside the storing furnace 5 are brought to the roll temperature of about 1050° C. at least without essentially additionally affecting the solidification temperature of the casting 4. Because of that the casting time of the casting machine 1 required for finishing a cast piece 4*a* by the storage location is multiplied (in the embodiment described four times) according to the transverse conveyor 6 in the storing furnace 5 before the rolling cycle for the particular cast piece 4*a* can begin.

With a casting time of 12.5 minutes a residence time of 50 minutes is available inside the storing furnace 5 for achieving the rolling temperature of 1050° C. which of course as required can be reduced by the emptying time.

During the residence time for the individual cast piece 4*a* in the storing furnace 5 the continuous casting work of the casting machine 1 naturally continues.

Since a cast piece 4*a* proceeds from the storing furnace 5 on the delivery roll bed 7 and reaches the continuous finishing line 9 in a time interval of about 12.5 minutes, a time of about 12.5 minutes is available also for each rolling cycle. The individual rolling time for each cast piece 4*a* inside the continuous finishing line 9 is however substantially shorter than the available cycle time. It amounts to only about 2.5 minutes e.g. with a cast piece 4*a* with cross sectional dimensions of 50×1600 mm with a 50 meter outlet length. Accordingly each individual rolling cycle includes a pause of about 10 minutes during which all plant components following it including the continuous finishing line 9 can be put out of operation. During this pause all normally required assembly and reconstruction work, particularly the roll changing in the individual four-high finishing rolling mills, can be performed, because this pause corresponds to a time which is many times, in fact four times, longer than the required rolling time.

In many cases the normal pause between two successive roll cycles is not sufficient to finish the assembly and reconstruction work being performed, especially in the continuous finishing line 9.

It is then naturally unavoidable that the idle time of the plant following the storing furnace 5 be suitably lengthened.

However the continuous operation of the casting machine 1 need not be interrupted. During the extended idle time of the plant components following the storing furnace 5, the continuously cast long billets 4*a* produced by the casting machine 1 must additionally be received in the storing furnace 5.

To allow the buffer storage, the storing furnace 5 is additionally equipped with buffer storage locations 15 for number of continuously cast long billets 4*b* in addition to the main storage locations 41 oriented substantially horizontally in the transverse conveyor 6. These buffer storage locations 15 are located in the vicinity of the storing furnace 5 beside the region containing the transverse conveyor 6. The buffer storage locations 15 are located one above another and of course so that they can be positioned individually by an elevator device 16 and in succession at the transport plane of the roller bed 2 for the continuously cast long billets 4*a* and 4*b*.

So that the individual buffer storage locations 15 may be loaded with continuously cast long billets 4*b*, a special delivery device is provided between the transverse conveyor 6 and the roller conveyor extending to the roller bed 2 and the buffer storage locations inside the storing furnace 5. This delivery device, like the transverse conveyor 6, can be a walking beam conveyor. While the walking beam transport device of the transverse conveyor 6 is however only designed so that it provides a transport step only in one transport direction, it is necessary in case of the delivery device associated with the buffer storage locations 15 to provide a design with which according to choice two transport devices opposite each other can be controlled. While it is necessary for loading the buffer storage locations 15 with continuously cast long billets 4*b* to complete the transport step of the transverse conveyor 6 to the buffer storage locations, the delivery device must also perform the transport to the transverse conveyor 6 to later empty the buffer storage locations 15.

Figure 3:
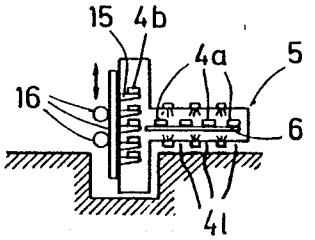
FIG. 3 is a cross sectional view taken along the section line III—III of FIG. 2.

For optimal operation of the storing furnace 5 during the idle time of the following downstream plant components, especially the finishing line 9, exceeding the usual pause between two roll cycles, it is particularly appropriate when the number of buffer storage locations 15 in the storing furnace 5 is selected to be at least equal to the number of the main storage locations 41 in it. In the indicated embodiment as shown in FIG. 3 the number of buffer storage locations 15 is even larger than that of the main storage locations 41. Five buffer storage locations 15 are present while there are only four main storage locations.

When idle times of the downstream plant components between successive rolling cycles lengthened from reconstruction, waiting and/or assembly times must be considered, if necessary the pauses of the two rolling cycles can be arranged in succession since the continuously cast long billets 4*b* formed during these can be taken without problem from the buffer storage locations 15 of the storing furnace 5. When the plant components downstream of the storing furnace 5 again are activated, then the rolling times of the two successive roll cycles are performed in immediate succession and because of that two continuously cast long billets 4*a* are drawn in a short time from the storing furnace 5. Of both freed main storage locations 41 in the transverse conveyor 6 one can be loaded with a cast piece 4*a* directly by the roller bed 2 from the casting machine 1, while a cast piece 4*b* can be transferred from one of the buffer storage locations 15 to the other main storage location 41.

If more than one cast piece 4*b* is to be taken from the buffer supply locations 15 during the idle time of the plant components downstream of the storing furnace 5, more than two roll cycles can be connected in immediate succession with shortened pauses to again carefully free the buffer storage locations 15 in the storing furnace 5.

If the pauses of two successive roll cycles which normally amount to 10 minutes are interrupted by introducing an additional rolling time of 2.5 minutes, then retaining a shortened pause of 3.75 minutes allows an additional two continuously cast long billets 4*a* and/or 4*b* to be rolled and thus transferred into the storing furnace 5 from the buffer storage locations 15 to the main storage locations 41 on the transverse conveyor 6.

Thus an optimum adjustment of the rolling mill plant components 9 to the continuously operating casting machine 1 is guaranteed and, simultaneously, a high quality end product is reliably made. The plant illustrated in FIGS. 4 to 6 differs from that of FIGS. 1 to 3 only because a four-high rolling mill 17 with a reversing drive is associated with the storing furnace 5 instead of a continuously operating finishing line 9. The four-high rolling mill 17 works as a pin rolling mill together with an output side coiling spool and/or spool furnace 18 and a inlet side coiling spool and/or spool furnace 19.

Figure 4:
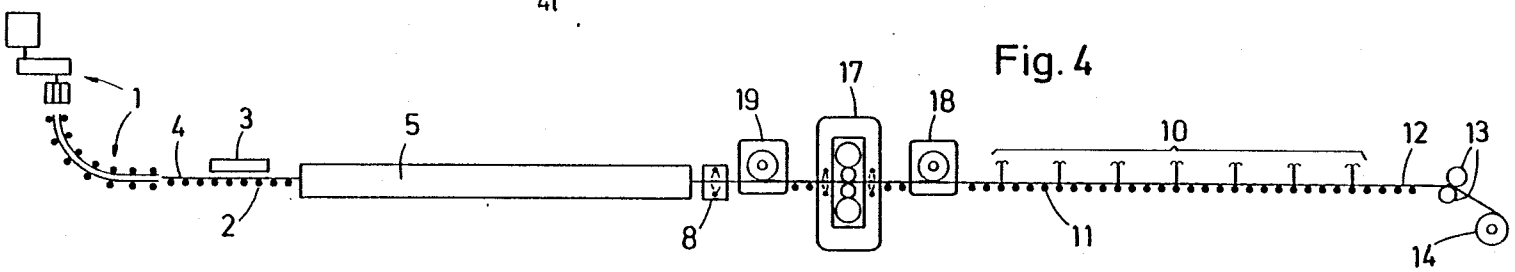
FIG. 4 is a side elevational view of another plant for making hot-rolled steel strip from cast billets according to my invention.
Figure 5:
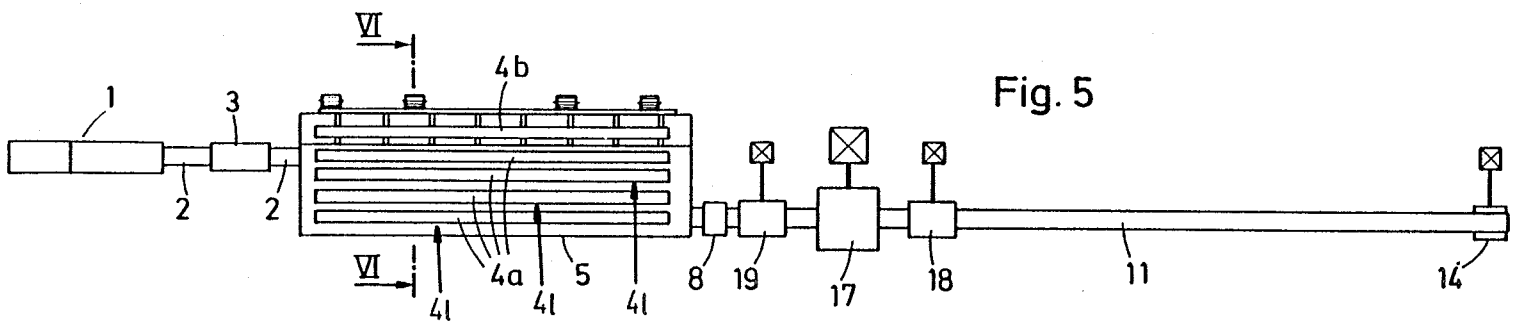
FIG. 5 is a top plan view of the plant according to FIG. 4.
Figure 6:
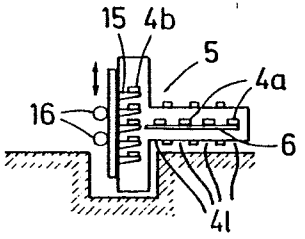
FIG. 6 is a cross sectional view taken along the section line VI—VI of FIG. 5.

The casting machine 1 and storing furnace 5 in FIGS. 4 to 6 agree completely however in structure and operation with those in the plant according to FIGS. 1 to 3.

I claim:

1. A method of making hot-rolled steel strip, comprising the steps of:

(a) continuously casting an elongated steel casting;

(b) transversely separating from said casting a succession of long billets while continuing uninterrupted formation of the casting so that each billet is formed by the continuous casting in a predetermined casting time;

(c) feeding said long billets directly and exclusively into a storage furnace in succession in a longitudinal direction of said long billets;

(d) displacing the long billets fed to said furnace transversely therein and storing a plurality of said long billets in linearly outstretched form in said furnace in substantially mutually parallel relationship for a multiple of said casting time without additional energy supply to said furnace;

(e) withdrawing said long billets from said furnace in said longitudinal direction in succession and after storage in said furnace for said multiple of said casting time;

(f) directly rolling each of said long billets upon its withdrawal from said furnace in at least one rolling mill during a rolling time which is only a fraction of said casting time to produce hot-rolled strip, whereby the long billets withdrawn in succession from said furnace are rolled in succession; and (g) operating said rolling mill discontinuously for the rolling of said billets so that interruptions are provided in the operation of said rolling mill which are substantially equal to the difference between said rolling time and said casting time.

2. The method defined in claim 1 wherein the long billets are stored in said furnace for about four times the casting time, said rolling time is about one-fifth of the casting time, and said interruptions are substantially four-fifths of the casting time.

3. The method defined in claim 1, further comprising the step of effecting roll-change in said rolling mill during at least one of said interruptions while storing a billet continuously cast during the roll-change in said furnace.

4. The method defined in claim 2 wherein said roll-change is effected during an interval of two of said interruptions provided in succession in the operation of said rolling mill.

* * * * *